US010676232B2

(12) United States Patent
Wieser

(10) Patent No.: US 10,676,232 B2
(45) Date of Patent: Jun. 9, 2020

(54) PACKAGING

(71) Applicant: Elopak AS, Spikkestad (NO)

(72) Inventor: Martin Kurt Wieser, Vettre (NO)

(73) Assignee: Elopak AS, Spikkestad (NO)

( * ) Notice: Subject to any disclaimer, the term of this patent is extended or adjusted under 35 U.S.C. 154(b) by 925 days.

(21) Appl. No.: 15/034,391

(22) PCT Filed: Nov. 5, 2014

(86) PCT No.: PCT/EP2014/073823
§ 371 (c)(1),
(2) Date: May 4, 2016

(87) PCT Pub. No.: WO2015/067661
PCT Pub. Date: May 14, 2015

(65) Prior Publication Data

US 2016/0297163 A1 Oct. 13, 2016

(30) Foreign Application Priority Data

Nov. 5, 2013 (GB) ..... 1319551.6

(51) Int. Cl.
*B31B 50/28* (2017.01)
*B31B 70/26* (2017.01)
(Continued)

(52) U.S. Cl.
CPC ..... *B65D 5/067* (2013.01); *B65B 3/025* (2013.01); *B65B 7/18* (2013.01); *B31B 50/28* (2017.08);
(Continued)

(58) Field of Classification Search
None
See application file for complete search history.

(56) References Cited

U.S. PATENT DOCUMENTS 3,120,089 A * 2/1964 Egleston ..... B29C 65/10 53/565
4,788,811 A * 12/1988 Kawajiri ..... B65B 3/025 493/165
(Continued)

FOREIGN PATENT DOCUMENTS

EP 0466271 A1 * 1/1992 ..... B65B 7/18
EP 0597355 A2 3/1995
(Continued)

*Primary Examiner* — Hemant Desai
*Assistant Examiner* — Tanzim Imam
(74) *Attorney, Agent, or Firm* — Burns & Levinson LLP; Bruce D. Jobse

(57) ABSTRACT

Apparatus including a forming anvil device for insertion into an end closure region of a partially formed container, the anvil device comprising a front edge region, a rear edge region, respective lateral edge regions extending between the front and rear edge regions and first and second forming portions each having a corner-forming zone including at the respective rear edge region and a lateral edge region arranged substantially orthogonal to each other, each lateral edge region, extending away from the corner-forming zone and towards the front edge region, also including an obliquely inwardly arranged portion. Also disclosed are apparatus for forming a bend in a packaging laminate about a boundary zone free from a pre-formed line of weakness and apparatus comprising a pressing device comprising an outermost pressing surface and connected to an arm member rotatable about an axis whereby rotating the arm member rotates the outermost pressing surface about the axis, wherein the outermost pressing surface is arranged at an oblique angle relative to the axis. Aspects of the partially formed container are also disclosed.

16 Claims, 9 Drawing Sheets

Figure 1:
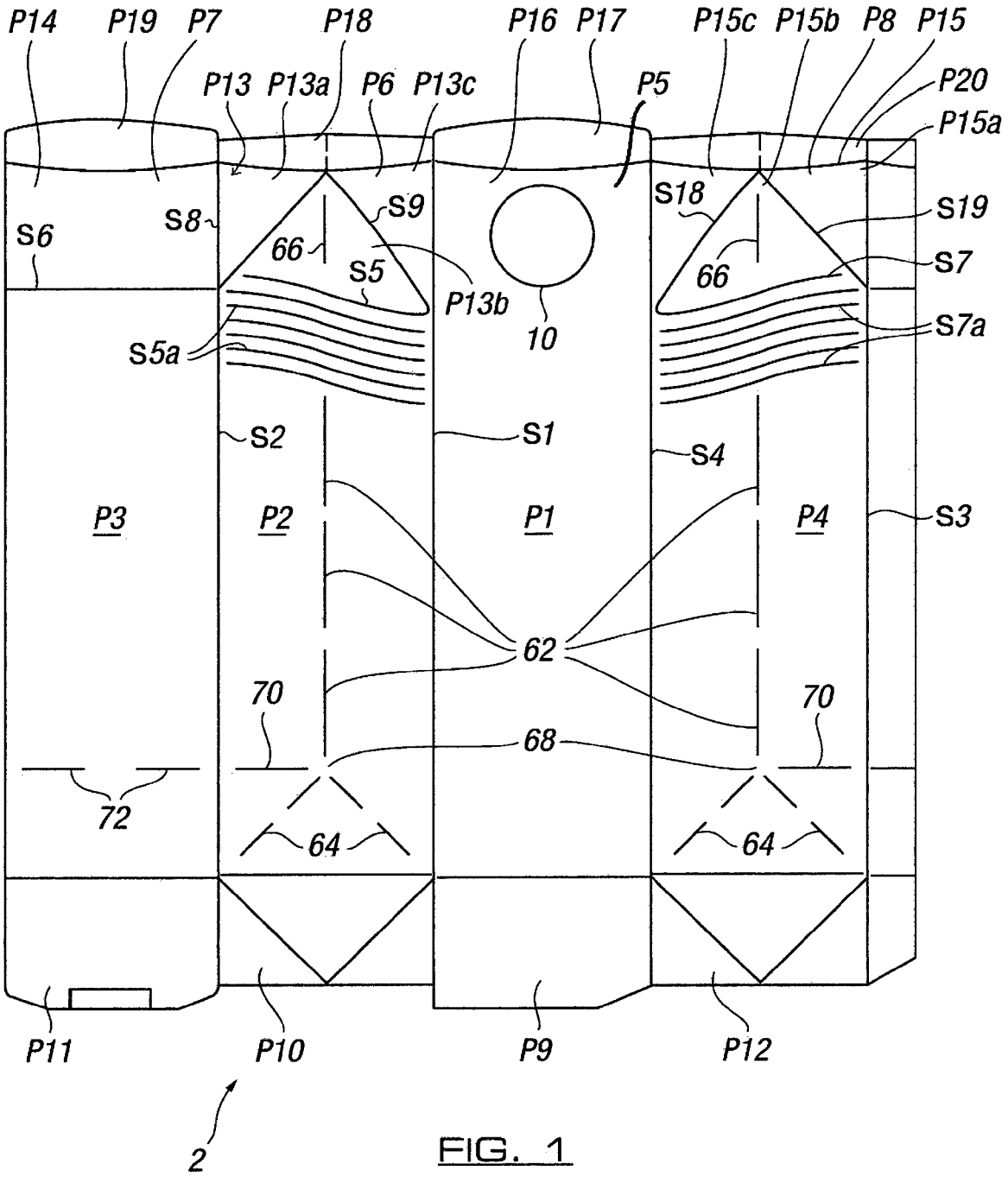

(51) Int. Cl.

| | |
|---|---|
| ***B65D 5/06*** | (2006.01) |
| ***B65B 3/02*** | (2006.01) |
| ***B65B 7/18*** | (2006.01) |
| *B31B 110/35* | (2017.01) |
| *B31B 100/00* | (2017.01) |

(52) U.S. Cl.
CPC ..... *B31B 2100/00* (2017.08); *B31B 2110/35* (2017.08)

(56) References Cited

U.S. PATENT DOCUMENTS 5,234,398 A * 8/1993 Larsen ..... B31B 50/00 493/156
5,445,793 A * 8/1995 Tuckner ..... B65B 55/10 422/28
5,538,491 A * 7/1996 Owen ..... B65B 43/24 493/165
6,343,459 B1 * 2/2002 Seaward ..... B65B 31/06 53/370.6
6,343,460 B1 * 2/2002 Fujikawa ..... B65B 3/025 493/184
6,357,203 B1 3/2002 Cicha et al.
6,385,950 B1 * 5/2002 Anderson ..... B65B 49/12 493/164
6,626,810 B1 * 9/2003 Bressler ..... B31B 50/00 493/165
7,380,389 B2 * 6/2008 Anderson ..... B31B 50/00 53/565
2006/0126275 A1 * 6/2006 Kortsmit ..... B65B 43/10 361/600
2013/0305659 A1 * 11/2013 Kenn ..... B65B 3/02 53/426

FOREIGN PATENT DOCUMENTS

GB 2205805 A 8/1987
WO 2010084660 A1 7/2010

* cited by examiner

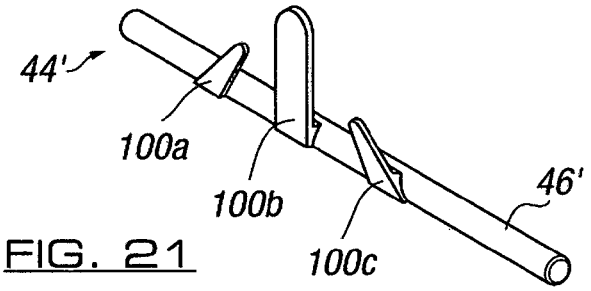
FIG. 21
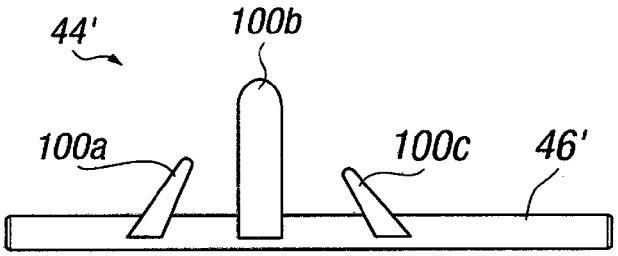
FIG. 22
FIG. 23
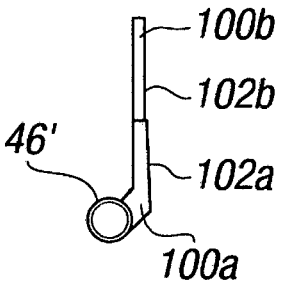
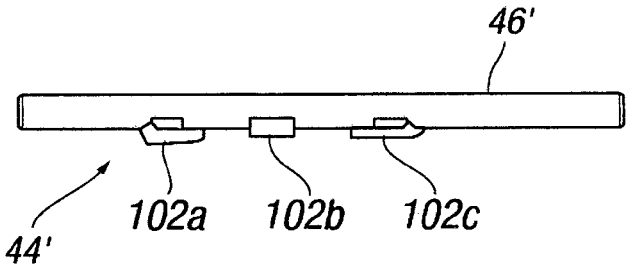
FIG. 24

PACKAGING

CROSS-REFERENCE TO RELATED APPLICATIONS

This application is a U.S. national stage application under 35 U.S.C. 371 of International Application No, PCT/EP2014/073823, filed on Nov. 5, 2014, and entitled IMPROVEMENTS IN OR RELATING TO PACKAGING, which in turn claims priority to and benefit of Great Britain Patent Application No, 13195516, filed on Nov. 5, 2013, which is incorporated by reference herein in its entirety for all purposes.

This invention relates to apparatus and methods for forming a container and to container blanks, containers formed therefrom.

It is known, in the construction of a paperboard-based container from a paperboard laminate container blank, that to perform satisfactory sealing of the end closures of the container to break or activate the lines of weakness that define the various sub-panels that dictate the form of the end closure so that the laminate material on both sides of the line of weakness is partially folded such that when the final sealing stage occurs the material bends about the lines of weakness more readily than is the pre-breaking or activation did not occur. In this way satisfactory sealing of the end closure can be made.

According to a first aspect of the present invention, there is provided apparatus including a forming anvil device for insertion into an end closure region of a partially formed container, the anvil device comprising a front edge region, a rear edge region, respective lateral edge regions extending between the front and rear edge regions and first and second forming portions each having a corner-forming zone at the respective rear edge region and a lateral edge region arranged substantially orthogonal to each other, each lateral edge region, extending away from the corner-forming zone and towards the front edge region, including an obliquely inwardly arranged portion.

According to a second aspect of the present invention, there is provided a method of forming an end closure of a partially formed container comprising receiving the partially formed container, inserting into an opening of the end closure a forming anvil device including a front edge region, a rear edge region, respective lateral edge regions extending between the front and rear edge regions and first and second forming portions each having a corner-forming zone including at the respective rear edge region and a lateral edge region arranged substantially orthogonal to each other, each lateral edge region, extending away from the corner-forming zone and towards the front edge region, including an obliquely inwardly arranged portion, so that respective corner-forming zones are brought to lie in adjacent internal corner end regions of the end closure, and pressing externally of the partially formed container in the region of the end closure corner end regions.

Owing to these two aspects of the invention, a forming anvil device can be provided so that in the forming of an end closure of a partially formed container, adjacent corner regions of the end closure are not only internally supported in order to produce bending about a boundary extending between the adjacent corner regions of the container but also to produce bending about a linear or non-linear boundary corresponding to the position of the respective obliquely inwardly arranged edge regions of the forming anvil device. In this way, the forming anvil can be used to form end closures of a wide variety of carton designs without the need to change or modify a packaging machine when changing from one carton design to another on that machine.

According to a third aspect of the present invention, there is provided apparatus for forming a bend in a packaging laminate about a boundary zone free from a pre-formed line of weakness comprising a first wall portion for abutting against an external surface of a first body panel of a partially formed container on one side of the boundary and a second wall portion extending obliquely inwardly with respect to the partially formed container for abutting against an external surface of a second body panel of a partially formed container on the other side of the boundary.

According to a fourth aspect of the present invention, there is provided a method of forming a bend in a packaging laminate about a boundary zone free from a pre-formed line of weakness comprising receiving the partially formed container, moving a forming device relative to the partially formed container such that a first wall portion of the forming device abuts against an external surface of a first body panel of the partially formed container on one side of the boundary and a second wall portion extending obliquely inwardly at an angle of the first wall portion abuts against an external surface of a second body panel of the partially formed container on the other side of the boundary, the arrangement being such that second wall portion contacts the partially formed container before the first wall portion and serves to urge the second body panel to substantially the same angle relative to the first body panel as between itself and the first wall portion.

Owing to these aspects, a boundary having no pre-formed linear weakness can be repeatedly and reliably formed with a forming device.

According to a fifth aspect of the present invention, there is provided apparatus comprising a pressing device comprising an outermost pressing surface and connected to an arm member rotatable about an axis whereby rotating the arm member rotates the outermost pressing surface about the axis, wherein the outermost pressing surface is arranged at an oblique angle relative to the axis.

According to a sixth aspect of the present invention, there is provided a method comprising rotating inwardly relative to a partially formed container a pressing device for pressing against an end closure sub-panel of the partially formed container defined by lines of weakness, the pressing device connected to an arm member rotatable about an axis whereby rotating the arm member rotates an outermost pressing surface of the pressing device inwardly as aforesaid, wherein the outermost pressing surface is arranged at an oblique angle relative to the axis such that the lower portion of the pressing device initially contacts the sub-panel at a lower region thereof, and as the pressing device continues on its rotary path, a contact area between the pressing surface and the sub-panel increases.

Owing to these aspects, it is possible to cause the inward folding of a gable end wall of a partially formed container having a boundary with an adjacent body sub-panel. That boundary may be a non-rectilinear boundary, the pressing device being usable to cause accurate folding about such a boundary.

According to a seventh aspect of the present invention, there is provided a container blank for forming a container and comprising a row of body sub-panels comprised of first, second, third and fourth body sub-panels arranged side-by-side, the boundaries between the body sub-panels being defined by respective, substantially straight boundary lines of weakness extending from top to bottom of the sub-panels, whereof each of the second and fourth body sub-panels include a plurality of substantially straight co-linear lines of weakness located between the respective straight boundary lines of weakness and arranged substantially perpendicularly to the row, wherein the plurality of substantially straight co-linear lines of weakness are impression lines made so that they are only visible on one side of the container blank.

According to a eighth aspect of the present invention, there is provided a container blank for forming a container and comprising a row of body sub-panels comprised of first, second, third and fourth body sub-panels arranged side-by-side, the boundaries between the body sub-panels being defined by respective, substantially straight boundary lines of weakness extending from top to bottom of the sub-panels, whereof each of the second and fourth body sub-panels include a plurality of substantially straight co-linear lines of weakness located between the respective straight boundary lines of weakness and arranged substantially perpendicularly to the row, wherein the plurality of substantially straight co-linear lines of weakness are lines made so that they are visible on at least one side of the container blank.

According to a ninth aspect of the present invention, there is provided a container blank for forming a container and comprising a row of body sub-panels comprised of first, second, third and fourth body sub-panels arranged side-by-side, the boundaries between the body sub-panels being defined by respective, substantially straight boundary lines of weakness extending from top to bottom of the sub-panels, whereof each of the second and fourth body sub-panels include a plurality of substantially straight co-linear lines of weakness located between the respective straight boundary lines of weakness and arranged substantially perpendicularly to the row, wherein the plurality of substantially straight co-linear lines of weakness consist of no more than six lines of weakness having gaps therebetween.

According to an tenth aspect of the present invention, there is provided a container comprising a loop of body sub-panels, the boundaries between sub-panels being defined by respective, substantially straight boundary lines of weakness extending from top to bottom of the sub-panels, whereof each of the second and fourth body sub-panels include a plurality of substantially straight co-linear lines of weakness located between the respective straight boundary lines of weakness and arranged substantially perpendicularly to the row, wherein the plurality of substantially straight co-linear lines of weakness are impression lines made so that they are only visible on one side of the container.

According to a eleventh aspect of the present invention, there is provided a container comprising a loop of body sub-panels, the boundaries between sub-panels being defined by respective, substantially straight boundary lines of weakness extending from top to bottom of the sub-panels, whereof each of the second and fourth body sub-panels include a plurality of substantially straight co-linear lines of weakness located between the respective straight boundary lines of weakness and arranged substantially perpendicularly to the row, wherein the plurality of substantially straight co-linear lines of weakness are lines made so that they are visible on at least one side of the container.

According to a twelfth aspect of the present invention, there is provided a container comprising a loop of body sub-panels, the boundaries between sub-panels being defined by respective, substantially straight boundary lines of weakness extending from top to bottom of the sub-panels, whereof each of the second and fourth body sub-panels include a plurality of substantially straight co-linear lines of weakness located between the respective straight boundary lines of weakness and arranged substantially perpendicularly to the row, wherein the plurality of substantially straight co-linear lines of weakness consist of no more than six lines of weakness having gaps therebetween.

Owing to these aspects, it is possible to provide a container with lines of weakness for collapsing the container, when empty, ready for discarding yet maintaining the carton integrity at an acceptable degree whilst the carton contains liquid product.

Advantageously, the container blank further comprises a row of end closure sub-panels corresponding to the body sub-panels, the boundaries of which are also defined by the substantially straight boundary lines of weakness, the second and fourth end closure sub-panels including at least one substantially straight line of weakness co-linear with the plurality of substantially straight co-linear lines of weakness on the second and fourth body sub-panels. The co-linear lines of weakness are preferably about half-way between respective boundary lines of weakness. Furthermore, at the bottom end region of the second and fourth body sub-panels diverging lines of weakness comprised of a plurality of substantially straight co-linear lines of weakness which extend obliquely to the row of sub-panels.

In order that the invention be clearly and completely disclosed, reference will now be made, by way of example, with reference to the accompanying drawings, in which:—

Figure 2:
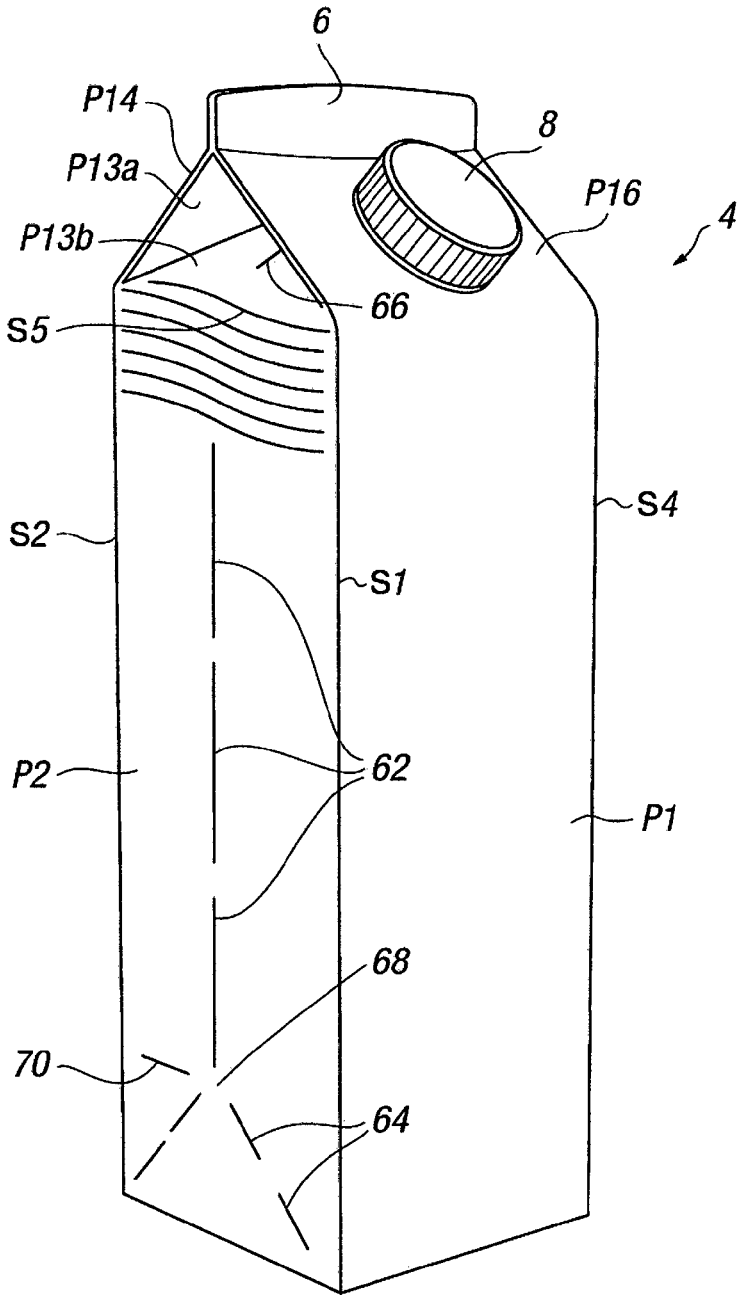
Figure 16:
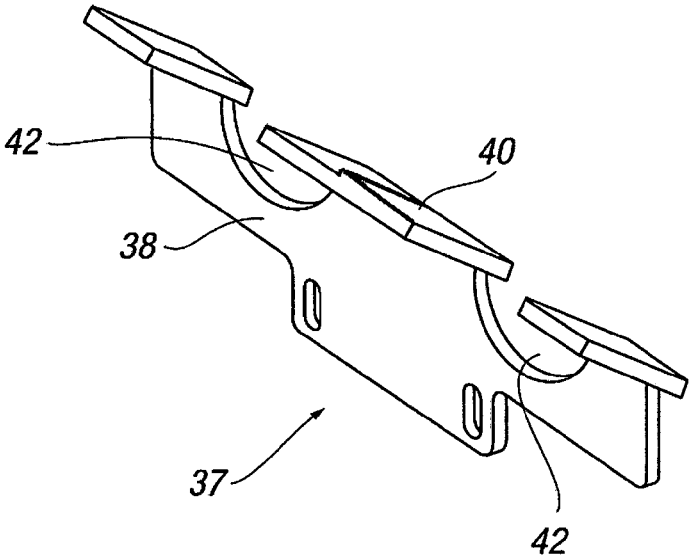
Figure 17:
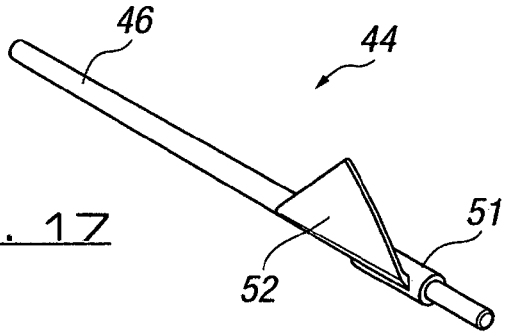
Figure 18:
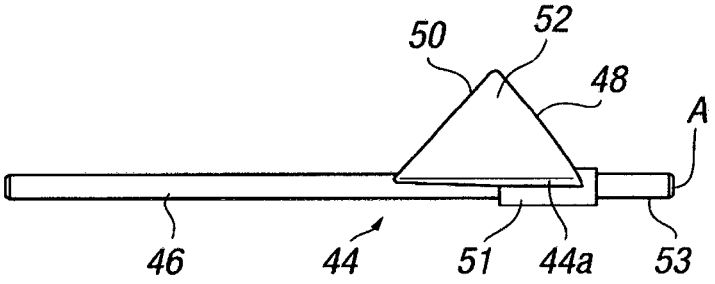
Figure 19:
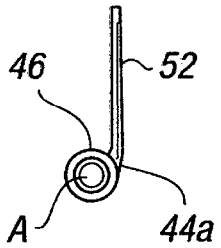
Figure 20:
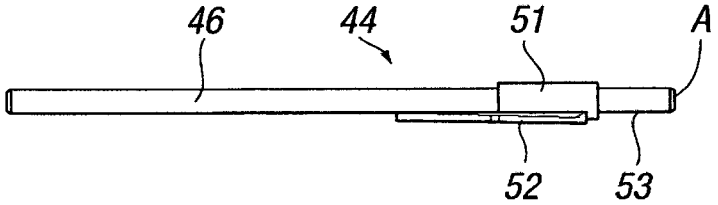
Figure 25:
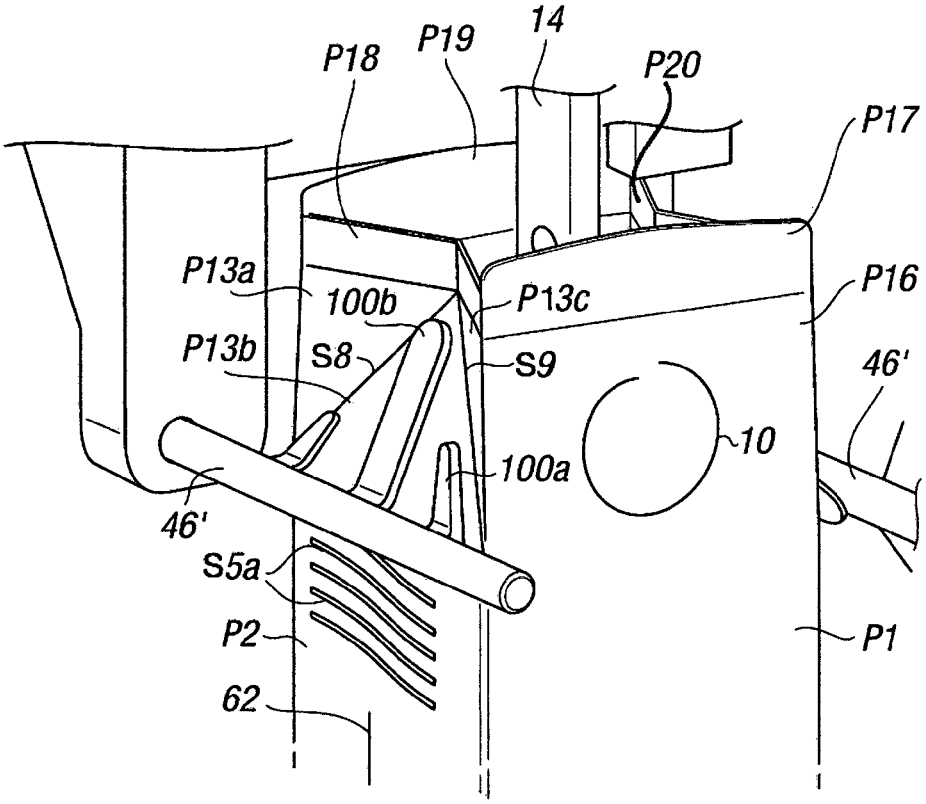

FIG. 1 shows a plan view of a container blank,

FIG. 2 shows a perspective view of a sealed and filled container constructed from the container blank of FIG. 1, FIGS. 3 to 7 show different views of an embodiment of an anvil device used in the forming of the container shown in FIG. 2, FIGS. 8 to 11 show different views of another embodiment of an anvil device, FIGS. 12 to 15 show different views of a further embodiment of an anvil device, FIG. 16 shows a perspective view of a forming device used in the forming of the container shown in FIG. 2, FIGS. 17 to 20 show different views of a pressing device used in the forming of the container shown in FIG. 2, FIGS. 21 to 24 show different views of a second embodiment of the pressing device, and FIG. 25 is a perspective view from above of the pressing device of FIGS. 21 to 24 in operation.

Referring to FIG. 1, a container blank 2 consists of a laminate consisting of at least a paperboard substrate layer and innermost and outermost layers of a moisture barrier thermoplastics (with the possible interposition of an oxygen barrier layer, e.g. aluminium foil, between the substrate and the innermost thermoplastics layer) and the container 4 formed therefrom (shown in FIG. 2) is used for packaging liquids, for example milk or fruit juice. The blank 2 consists of four body sub-panels P1-P4 with a fifth standard sealing panel, bounded by pre-formed lines of weakness in the form of score lines S1-S4 there among.

The body sub-panels P1 to P4 are bounded at their lower edges by further lines of weakness in the form of score lines and thereby divided from a row of bottom end closure panels P9 to P12.

The body sub-panels P2 to P4 are also bounded at their upper edges by further lines of weakness in the form of score lines S5 to S7 and thereby divided from a row of top obturating sub-panels P13 to P15. The body sub-panel P1 does not have a pre-formed line of weakness at the boundary with its adjacent top obturating sub-panel P16. The panels P16 and P14 are quadrangular and form respective quadrangular roof panels of the gable-topped container 4, whilst the sub-panels P13 and P15 are quadrangular and each divided by respective oblique score lines S8, S9, S18 and S19 into three substantially triangular sub-sub-panels P13*a* to P13*c* and P15*a* to P15*c*. The row of top obturating panels P13 to P16 are bounded at their upper edges by a row of top-sealing panels P17 to P20 to form a sealing fin 6 of the carton 4. In addition, a pour spout fitment 8 is applied either to the outside or the inside of the laminate of the sub-panel P16 over or through a loop of weakness 10.

The oblique score lines S9 and S18 include a slight curvature along their length which bulges towards the top obturating sub-panel P16, whilst the oblique score lines S8 and S19 are straight. In addition, the score lines S5 and S7 are of a wave-form and in a generally downward direction from around the level of the score line S6 to a lower level where they join the respective score lines S9 and S18. Therefore, the container 4 formed is an asymmetric gable-top container in which the height of the rear body sub-panel P3 is greater than the height of the front body sub-panel P1. Beneath the score lines S5 and S7 are a plurality of respective wave-form score lines S5*a* and S7*a* arranged parallely to each other. The score lines S5*a* and S7*a* are confined to the upper regions of the body sub-panels P2 and P4.

The process of converting the container blank 2 to the container 4 begins with sealing the standard fifth panel to the inside surface of sub-panels P3, P11, P14 and P19 and folding along the score line S1 to form a flat container sleeve open at both ends. The flat container sleeves are then loaded into a packaging machine, usually a so-called form-fill-seal machine. The machine comprises a plurality of mandrels fixed to a rotary hub which is rotated stepwise about its own axis. The mandrels are equiangularly spaced about the axis, and in turn receive container sleeves; the sleeves in turn have the bottom end closure panels folded-in; in turn have a hot end press applied to the outer surface of the end closures, to heat- and pressure-seal the bottom end closure panels together; the sealed bottom end closures being cooled on the mandrels and in turn the container sleeves, now closed at one end, are removed from the mandrels into pockets of a linear conveyor.

Figure 3:
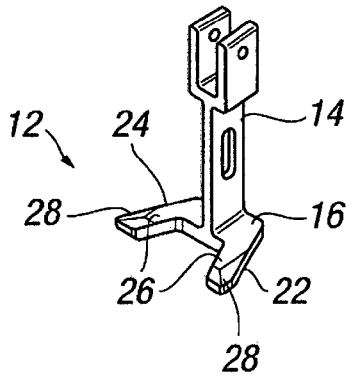
Figure 4:
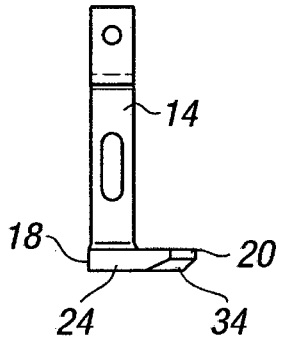
Figure 5:
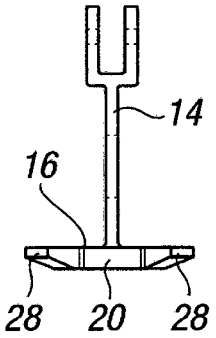
Figure 6:
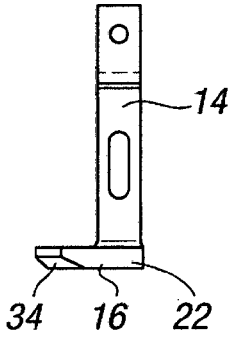
Figure 7:
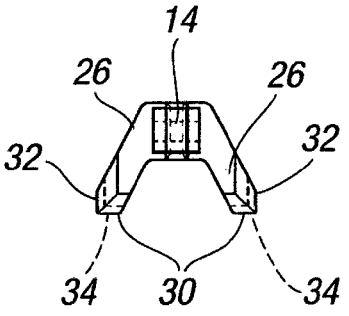
Figure 8:
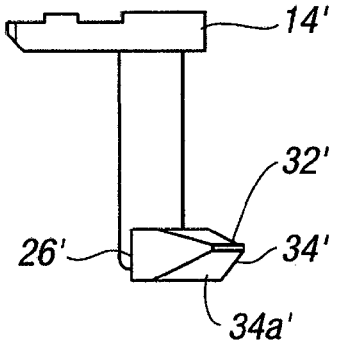
Figure 9:
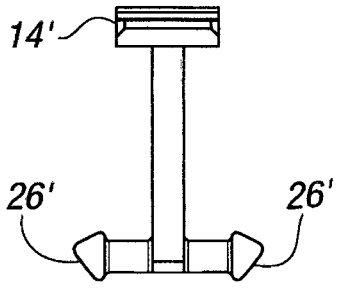
Figure 10:
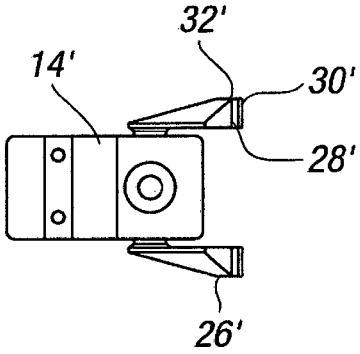
Figure 11:
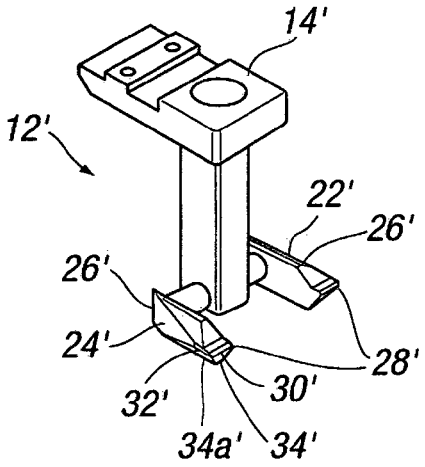
Figure 12:
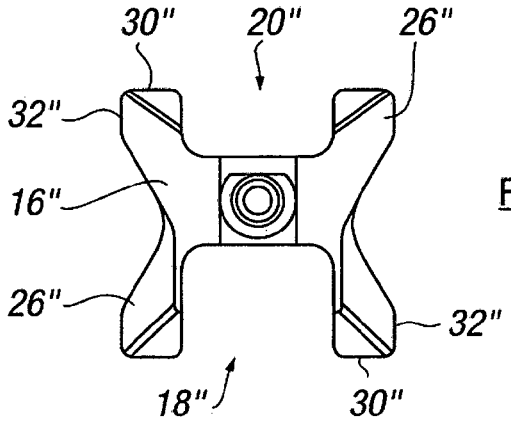
Figure 13:
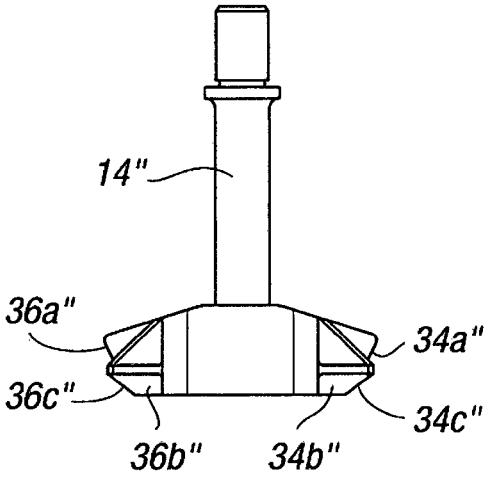
Figure 14:
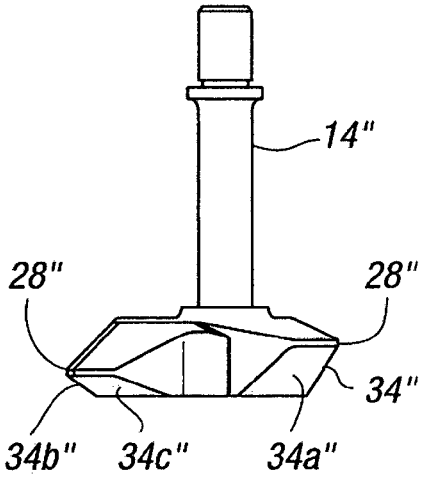
Figure 15:
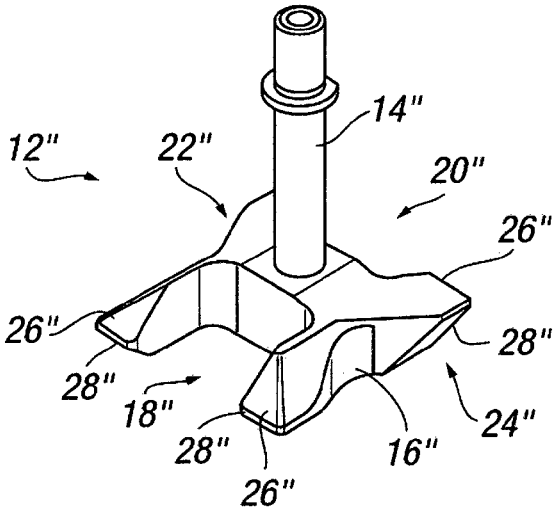

In order for the top obturating sub-panels to be closed and sealed to form a top end closure, the score lines need to be broken or activated to make the sealing process easier to complete. The score line S6 is broken to assist in the formation of the rear top obturating sub-panel. The score line S6 is broken with the assistance of a forming anvil 12 shown in FIGS. 3 to 7, FIGS. 8 to 11 and FIGS. 12 to 15. Referring to FIGS. 3 to 7, the anvil 12 comprises a bracket 14 for connecting at one end to the packaging machine in a standard manner by way of a fixing pin. At the opposite end of the bracket an anvil body 16 is attached and which includes a front edge region 18, a rear edge region 20 and respective lateral edge regions 22 and 24 extending between the front and rear edge regions. At the rear edge region 20, a pair of first and second forming portions 26 extend rearwardly outwardly from the anvil body 16 and terminate in multi-faceted end regions 28, there being a gap between the pair of forming portions 26 resulting in an anvil body 16 which substantially C-shaped in plan view (see FIG. 7). The forming anvil 12 is lowered into the open ended top closure region of the partially formed container to a position at which the multi-faceted end regions 28 are internally of the rear upper corners of the container 4 defined as the junction between the score line S6 and the wave-from score lines S5 and S7. It will be seen from FIG. 7 that each of the forming portions 26 include a corner-forming zone having edges 30 and 32 arranged substantially orthogonal to each other to correspond to the internal corner regions inside the partially formed container where the body sub-panels P2, P3 and P4 are arranged relative to each other. Referring particularly to FIGS. 3 and 7, the respective lateral edge regions 22 and 24 have portions which extend obliquely inwardly away from respective corner-forming zones towards the front edge region 18 so that no unwanted bending about the wave-form score lines S5 and S7 occurs as a result of the presence of the anvil, which would cause substantially horizontal creasing of the laminate deviating from the actual wave-form score lines.

The edges 30 and 32 at their respective under sides have undercut surfaces 34, 34*a*, 36 and 36*a* angled at substantially 45 degrees to the horizontal and which ensure that there is only minimal contact areas at the internal upper rear corner zones of the partially formed container, especially at the region of the edge 32 which projects a short distance along the inside surface at the junction between the sub-panels P2, P13 and P4, P15 in order that there is no unwanted disruption to the wave-form score lines S5, S5*a* and S7, S7*a*. In practice, the respective edges 32 will lie in the gap between the respective wave-form score lines S5, S7 and those wave-form score lines S5*a* and S7*a* immediately below to an extent enough to assist the inward folding of the top obturating sub-panels P13 and P15.

Referring to an alternative embodiment of the forming anvil in FIGS. 8 to 11, the anvil 12' comprises a bracket 14' for connecting at one end to the packaging machine. At the opposite end of the bracket 14' a pair of first and second forming portions 26' extend rearwardly outwardly from connectors which connect them to the bracket 14'. The forming portions 26' terminate in multi-faceted end regions 28'. The forming anvil 12' is lowered into the open ended top closure region of the partially formed container to a position at which the multi-faceted end regions 28' are internally of the rear upper corners of the container 4 defined as the junction between the score line S6 and the wave-from score lines S5 and S7. It will be seen from FIGS. 8 to 11 that each of the forming portions 26' include a corner-forming zone having edges 30' and 32' arranged substantially orthogonal to each other to correspond to the internal corner regions inside the partially formed container where the body sub-panels P2, P3 and P4 are arranged relative to each other. The respective lateral edge regions 22' and 24' have portions which extend obliquely inwardly away from respective corner-forming zones towards the front edge region so that no unwanted bending about the wave-form score lines S5 and S7 occurs as a result of the presence of the anvil 12', which would cause substantially horizontal creasing of the laminate deviating from the actual wave-form score lines.

As with the embodiment of the anvil 12 in FIGS. 3 to 7, the edges 30' and 32' at their respective under sides have undercut surfaces 34', 34*a*', 36' and 36*a*' angled to ensure that there is only minimal contact areas at the internal upper rear corner zones of the partially formed container, especially at the region of the edge 32' which projects a short distance along the inside surface at the junction between the sub-panels P2, P13 and P4, P15 in order that there is no unwanted disruption to the wave-form score lines S5, S5*a* and S7, S7*a*. In practice, the respective edges 32' will lie in the gap between the respective wave-form score lines S5, S7 and those wave-form score lines S5*a* and S7*a* immediately below to an extent enough to assist the inward folding of the top obturating sub-panels P13 and P15.

The anvil 12 is therefore not only suitable for forming the top end closure of the container blank and container of FIGS. 1 and 2, but also for a wide variety of containers, such as known standard gable-top arrangements.

Referring to FIGS. 12 to 15, a further embodiment of the anvil 12" comprises a bracket 14" for connecting at one end to the packaging machine in a standard manner. At the opposite end of the bracket the anvil body 16" is attached and which includes a front edge region 18", a rear edge region 20" and respective lateral edge regions 22" and 24" extending between the front and rear edge regions. At both the front and rear edge regions 18" and 20", two pairs of first, second, third and fourth forming portions 26" extend outwardly from the anvil body 16" and terminate in multi-faceted end regions 28", there being a gap between the front and rear pairs of forming portions 26" resulting in an anvil body 16" which is substantially X-shaped in plan view. The forming anvil 12" is lowered into the open ended top closure region of the partially formed container to a position at which the multi-faceted end regions 28" are internally of the front and rear upper corners of the container 4, the rear upper corners being defined as the junction between the score line S6 and the wave-from score lines S5 and S7 and the front upper corners being defined as the region of the junction between the score lines S5 and S9, and S7 and S18 and where the body sub-panel P1 does not have a pre-formed line of weakness at the boundary with its adjacent top obturating sub-panel P16. It will be seen from FIG. 12 that each of the forming portions 26" includes a corner-forming zone having edges 30" and 32" arranged substantially orthogonal to each other to correspond to the internal corner regions inside the partially formed container where the body sub-panels P1, P2, P3 and P4 are arranged relative to each other. In this embodiment not only do the rear forming portions 26" have respective lateral edge regions 22" and 24" which have portions extending obliquely inwardly away from respective rear corner-forming zones towards the front edge region 18", but also the front forming portions 26" have respective lateral edge regions 22" and 24" which have portions extending obliquely inwardly away from respective front corner-forming zones towards the rear edge region 20". Again, this ensures that no unwanted bending about the wave-form score lines S5 and S7 occurs as a result of the presence of the anvil, which would cause substantially horizontal creasing of the laminate deviating from the actual wave-form score lines.

As with the embodiments of FIGS. 3 to 7 and FIGS. 8 to 11, the edges 30" and 32" at their respective under sides have undercut surfaces 34", 34*a*", 34*b*", 34*c*", 36", 36*a*", 36*b*" and 36*c*" angled to ensure that there is only minimal contact areas at the internal upper front and rear corner zones of the partially formed container, especially at the region of the edges 32" which project a short distance along the inside surface at the junction between the sub-panels P2, P13 and P4, P15 in order that there is no unwanted disruption to the wave-form score lines S5, S5*a* and S7, S7*a*. In practice, the respective edges 32" will lie in the gaps between the respective wave-form score lines S5 and S7 and the wave-form score lines S5*a* and S7*a* immediately below to an extent enough to assist the inward folding of the top obturating sub-panels P13 and P15. The angle of the undercut surfaces 34", 34*a*", 34*b*", 34*c*", 36", 36*a*", 36*b*" and 36*c*" may vary between the front edge forming portions and the rear edge forming portions. In the embodiment shown in FIGS. 12 to 15, the undercut surfaces 34", 34*a*", 36" and 36*a*" are at an angle of substantially 60° to the horizontal and the surfaces 34*b*", 34*c*", 36*b*" and 36*c*" have an angle of substantially 35° to the horizontal.

Referring to FIGS. 2 and 16, the container 4 has, as already mentioned, no pre-formed line of weakness at the junction between the front body sub-panel P1 and the front top obturating sub-panel P16 and therefore resulting in a smoother transition between those two-panels as would be the case if there was a pre-formed linear weakness present. During the container forming process, in order to activate the bending of the top obturating sub-panel P16 relative to the body sub-panel P1, a forming device 37, as shown in FIG. 16, can be used. The forming device 37 comprises a first wall portion 38 which includes a part which enables connection to another part of the packaging form-fill-seal machine and a second wall portion 40 which extends obliquely away from the first wall portion 38. The inner surface of the first wall portion 38 seen in FIG. 16 is brought to bear or abut against the upper part of the body sub-panel P1. As it does so, the second wall portion 40 urges the top obturating sub-panel P16 to bend at the junction between the sub-panels P1 and P16 and as the forming device continues to move towards the front sub-panel P1 more of the sub-panel P16 is brought to bear or abut against the underside of the second wall portion 40. The angle between the first wall portion 38 and the second wall portion 40 is such that the activating of the bending of the sub-panel P16 relative to the sub-panel P1 is sufficient for a suitable top seal to be made at the end of the production process. The angle between the first wall portion 38 and the second wall portion 40 is preferably between substantially 30 degrees and substantially 65 degrees. In the embodiment shown in FIG. 13, this angle is around 51 degrees.

Since it is preferable that the form-fill-seal machine is a double-indexing machine, so that actions at the various stations of the machine occur on two adjacent partially formed containers at the same time, and that the partially formed containers will have the pour spout fitments in one conveyor line, the second wall portion 40 has two gaps between different sections and the first wall portion 38 has two corresponding cut-out portions 42. The gaps and the cut-out portions form spaces to accommodate the pour spout fitments 8 of the two partially formed containers being acted upon by the forming device 37, there being a section of the second wall portion 40 located on each side of the respective pour spout fitments 8 to ensure sufficient bending across the whole width of the container at the boundary between the sub-panels P1 and P16.

Referring to FIGS. 17 to 20, a pressing device 44 is mounted to an arm member 46 rotatable about its longitudinal axis A. The pressing device 44 is substantially triangular in shape with a base and obliquely angled side edges 48 and 50 extending upwardly towards an apex. The pressing device 44 is mounted such that, in a side view, a portion 44*a* of the pressing device 44 is angled upwardly and away from the arm member 46 and then an outermost pressing surface 52 extends substantially vertically upwardly towards the apex. The portion 44*a* has a height which is at its maximum extent towards an outer free end 53 of the arm member 46 and which gradually decreases across the width of the base of the pressing device. The outermost pressing surface 52 is planar and smooth in the sense that it is a substantially flat uniform surface uninterrupted across its surface area. The shape of the pressing device 44 roughly corresponds to the shape of the sub-sub-panels P13*b* and P15*b* against which the pressing device 44 is pressed, with the edge 48 being curved to correspond to the score lines S9 and S18 and the side edge 50 corresponding to the score lines S8 and S19. The outermost pressing surface 52 is arranged obliquely relative to the axis A in such a manner that the curved edge 48 of the pressing device is at a further distance perpendicularly from the axis A than is the edge 50. In relation to the container shown in FIG. 2, the outermost pressing surface 52 contacts the laminate material in the area of sub-sub-panels P13*b* and P15*b* where the material surface curves downwardly along the score lines S5 and S7 towards the junction with the sub-panels P1 and P16, and which is accommodated by the shape of the portion 44*a* where the part at which it has its maximum height corresponds to the region where the score line S1 and S4 are adjacent the score lines S5 and S7 respectively.

In order to break or to activate the bending of the laminate material about the score lines S5 and S7, the form of the outermost pressing surface 52, which is the surface that contacts the sub-sub-panels P13*b* and P15*b*, is such that as the arm member 46 is rotated and the pressing device moves towards the partially formed container, the first point of contact with the surface of the laminate is made by that part of the outermost pressing surface 52 which is the furthest perpendicularly from the axis A. In this way, a rolling effect is created for contacting the laminate material in the region where the wave-from score lines S5, S5*a*, S7 and S7*a* are present. Contact between the pressing device 44 and the parts of the sub-sub-panels P13*b* and P15*b* towards the rear of the container where the score lines S5 and S7 are at a higher level then follows where the outermost pressing surface 52 is at the least distance perpendicularly from the axis A at the edge 50. This rolling motion provides that region of the laminate with sufficient pressure to cause the breaking or activation of the top two or three wave-from score lines S5, S5*a*, S7 and S7*a* without causing unwanted creasing of the laminate at those locations.

In a double-indexing form-fill-seal machine, four pressing devices 44 are present (two for each partially formed container) at a top closure pre-breaking station. Furthermore, the mechanism by which the pressing devices 44 are connected to the form-fill-seal machine may vary according to the type of machine the pressing devices are being mounted to. This may also coincide with a change of the shape or form of the portion 44*a*.

The pressing device 44 may be of uniform thickness, as shown in FIGS. 17 to 20, or it may alternatively be that the substantially triangular flap is thicker on one side and gradually decreases in thickness across its width so as to form a wedge-shape.

Advantageously, the pressing device is adjustable along the length of the arm member 46 in order to be set at the correct position along the length of the arm member 46. For example, the pressing device 44 could be mounted to a tubular sleeve 51, which fits closely over the arm member 46 and is securable in the correct position in a convenient manner.

Referring to FIGS. 21 to 24, a second embodiment of the pressing device 44' comprises a plurality of finger members 100*a*, 100*b* and 100*c* mounted to the arm member 46'. In the example shown, three finger members are arranged such that the projected outline of all three finger members forms a substantially triangular profile with a central finger member 100*b* extending substantially perpendicularly from the arm member and two lateral finger members 100*a* and 100*c* on respective opposite sides of the central finger member 100*b* and angled inwardly towards the central finger member to form the substantially triangular profile. The central finger member 100*b* and the finger member 100*c* include outermost pressing surfaces 102*b* and 102*c* that are arranged substantially parallely to the axis A' and the finger member 100*a* includes an outermost pressing surface 102*a* arranged obliquely relative to the axis A'. The finger member 100*a* has an outer edge 48' which includes a slight curvature to correspond to the score lines S9 and S18 in a similar manner to the pressing device 44 of FIGS. 17 to 20. The outermost pressing surface 102*a* at the curved edge 48' of the finger member 100*a* is at a further distance perpendicularly from the axis A' than is the opposite edge of the finger member 100*a* or the outermost pressing surfaces 102*b* and 102*c*. Owing to the oblique arrangement of the outermost pressing surface 102*a*, the arrangement is such that the outermost pressing surface 102*a* initially contacts the laminate material in the area of sub-sub-panels P13*b* and P15*b* where the material surface curves downwardly along the score lines S5 and S7 towards the junction with the sub-panels P1 and P16. Although three finger members are shown, a minimum of two finger members could be used to form the substantially triangular profile.

The finger members 100*a* and 100*c* are mounted such that, in a side view, a lower portion of them is angled upwardly and away from the arm member 46'. These lower portions of the finger members 100*a* and 100*c* correspond to the end regions of the score lines S5 and S7 and are angled so as not to disrupt the proper activation of the score lines S5 and S7.

In a similar way to the pressing device 44 of FIGS. 17 to 20, a step-wise system for contacting the laminate material is created in the region where the wave-from score lines S5, S5*a*, S7 and S7*a* are present. Contact between the finger members 100*b* and 100*c* and the parts of the sub-sub-panels P13*b* and P15*b* towards the rear of the container where the score lines S5 and S7 are at a higher level follows where the outermost pressing surfaces 102*b* and 102*c* is at the least distance perpendicularly from the axis A'. This step-wise motion provides that region of the laminate with sufficient pressure to cause the breaking or activation of the top two or three wave-from score lines S5, S5*a*, S7 and S7*a* without causing unwanted creasing of the laminate at those locations.

The finger member 100*a* may be of uniform thickness or it may alternatively be that the substantially finger member 100*a* is thicker on one side and gradually decreases in thickness across its width so as to form a wedge-shape, as shown in FIGS. 21 to 24.

Advantageously, at least one of the finger members are adjustable along the length of the arm member 46' in order to be set at the correct position along the length of the arm member 46'.

Referring to FIG. 25, a pair of the pressing devices 44' of FIGS. 21 to 24 are shown connected to a part of the form-fill packaging machine which causes the arm members 46' to rotate about the axes A' with the partially formed container 4 therebetween. The bracket 14 of the anvil 12 can be seen extending from the open top of the partially formed container. The finger members 100*a*, 100*b* and 100*c* are shown part way through their rotary path pressing against the laminate material of the top obturating sub-sub-panel P13*b* and activating the score lines S5, S8 and S9 whilst the anvil 12 is in place.

Referring back to FIGS. 1 and 2, the body sub-panels P2 and P4 include, half way between the respective boundary lines of weakness S1, S2 and S3, S4, a plurality of substantially straight co-linear score lines 62 extend along the majority of the length of the sub-panels P2 and P4. At the lower end of the plurality of co-linear score lines 62 two diverging lines of a plurality of further substantially straight co-linear score lines 64 extend obliquely towards the bottom corner regions of the body sub-panels P2 and P4, the angle of the further substantially straight co-linear score lines 64 to the bottom edges of the respective body sub-panels P2 and P4 being between substantially 40 degrees to substantially 50 degrees, around 45 degrees being shown. According to the present invention at least one of the following angles mentioned above is selected from at least one of the following: 40, 41, 42, 43, 44, 45, 46, 47, 48, 49, 50. In addition, the top obturating sub-sub-panels P13*b* and P15*b* may also include centrally thereof and co-linear with the plurality of substantially straight co-linear score lines 62 a substantially straight score line 66. Furthermore, although there is no actual junction between the score lines 62 and 64, there is a projected junction 68 from which extends substantially parallely to the bottom edge of the body sub-panels P2 and P4 respective substantially straight score lines 70 which extend from the projected junction 68 away from the front body sub-panel P1. Moreover, a plurality of substantially straight score lines 72 co-linear with the substantially straight score lines 70 of sub-panels P2 and P4 extend across the rear body sub-panel P3.

The substantially straight score lines 62, 64, 66, 70 and 72 have the functional purpose of assisting the folding of the container when it has been emptied of its contents for waste disposal and/or recycling. The folding of the container along the score lines 62, 64, 66, 70 and 72 allow the emptied container to be folded into a substantially flat state so that its volumetric space occupied is reduced for waste storage purposes. The substantially straight score lines 62, 64, 66, 70 and 72 appear as a broken line so that, whilst still providing the waste disposal function, the carton integrity is kept at an acceptable degree when it still contains some product owing to the presence of the gaps between the score lines.

There are no more than six substantially straight lines of weakness 62 included on the body sub-panels P2 and P4 each separated by a gap, three being shown in FIGS. 1 and 2. This arrangement has an advantage over multiple sections in a dashed line as is known, in that the container integrity is better maintained with a limited number of lines of weakness separated by relatively large gaps compared to multiples of short lines with relatively small gaps threbetween.

The substantially straight score lines 62, 64, 66, 70 and 72 may be impression lines of weakness made so that they are only visible on one side of the container blank, preferably the outside surface of the blank, which improves the container integrity when it still contains some product owing to the fact that a higher degree of folding force is required to make a fold about those lines of weakness compared to a score line which is visible of both sides of the container blank. This is useful therefore when folds have a secondary purpose and are, in this example, intended to be made when the product is emptied and the container is to be disposed of.

In this specification, reference to lines of weakness and score lines relate to such pre-formed lines in the laminate packaging material that may be seen on both the inside and outside surfaces of the container blank or to impression lines. The various lines of weakness and score lines mentioned may be a mixture of both of these types of pre-formed lines, for example in addition to the lines of weakness 62, 64, 66, 70 and 72 being impression lines of weakness, as mentioned above, the score lines S5, S5*a*, S7, and S7*a* could also be impression lines whilst the others are score lines which may be seen on both the inside and outside surfaces of the container blank.

The invention claimed is:

1. Apparatus including a forming anvil device for insertion into an end closure region of a partially formed container, the anvil device comprising:

a front edge region, a rear edge region, respective lateral edge regions extending between the front and rear edge regions, and first and second forming portions each having a corner-forming zone including the rear edge region and one of the lateral edge regions arranged orthogonal to each other, each lateral edge region extending away from the corner-forming zone and towards the front edge region, each lateral edge region including an obliquely inwardly arranged portion, wherein the apparatus further comprises a pressing device comprising an outermost pressing surface and being connected to a horizontal arm member running across one side of the partially formed container and rotatable about an axis, whereby rotating the arm member rotates the outermost pressing surface about the axis, wherein the outermost pressing surface is arranged at an oblique angle relative to the axis, wherein the outermost pressing surface is formed by three finger members mounted on the horizontal arm member and arranged such that the three finger members form a triangular profile with a central finger member extending perpendicularly from the horizontal arm member and two lateral finger members, on respective opposite sides of the central finger member, angled inwardly towards the central finger member.

2. Apparatus according to claim 1, wherein said first and second forming portions extend rearwardly outwardly and terminate in multi-faceted end regions.

3. Apparatus according to claim 1, wherein the first and second forming portions are connected to a bracket by way of connectors.

4. Apparatus according to claim 1 further comprising third and fourth forming portions each having a corner-forming zone including the front edge region and one of the lateral edge regions arranged orthogonal to each other, each lateral edge region extending away from the corner-forming zone and towards the rear edge region, each lateral edge region including an obliquely inwardly arranged portion.

5. Apparatus according to claim 4, wherein said third and fourth forming portions extend rearwardly outwardly and terminate in multi-faceted end regions.

6. Apparatus according to claim 1 wherein the first and second forming portions are part of an anvil body, there being a gap present in the anvil body between the first and second forming portions.

7. Apparatus according to claim 4 wherein the third and fourth forming portions are part of an anvil body, there being a gap present in the anvil body between the third and fourth forming portions.

8. Apparatus according to claim 1, wherein each of the corner-forming zones has edges arranged orthogonal to each other that correspond to internal corner regions inside the partially formed container.

9. Apparatus according to claim 1, wherein each of the corner-forming zones, at their respective under sides, have undercut surfaces.

10. Apparatus according to claim 8, wherein the undercut surfaces are angled at 45 degrees to a horizontal line.

11. Apparatus according to claim 1, further comprising a forming device for forming a bend in a material of the partially formed container about a boundary zone free from a pre-formed line of weakness, the forming device comprising a first wall portion for abutting against an external surface of a first body panel of the partially formed container on one side of the boundary zone and a second wall portion extending obliquely inwardly with respect to the partially formed container for abutting against an external surface of a second body panel of the partially formed container on another side of the boundary zone.

12. A method of forming an end closure of a partially formed container, the method comprising: receiving the partially formed container, inserting into an opening of the end closure a forming anvil device including a front edge region, a rear edge region, respective lateral edge regions extending between the front and rear edge regions, and first and second forming portions each having a corner-forming zone including the rear edge region and one of the lateral edge regions arranged orthogonal to each other, each lateral edge region extending away from the corner-forming zone and towards the front edge region, each lateral edge region including an obliquely inwardly arranged portion, so that respective corner-forming zones are brought to lie in adjacent internal corner end regions of the end closure, and pressing externally of the partially formed container in a region of the internal corner end regions, wherein the method further comprises rotating inwardly relative to the partially formed container a pressing device for pressing against an end closure sub-panel of the partially formed container defined by lines of weakness, the pressing device connected to a horizontal arm member running across one side of the partially formed container and rotatable about an axis, whereby rotating the arm member rotates an outermost pressing surface of the pressing device inwardly, wherein the outermost pressing surface is arranged at an oblique angle relative to the axis such that a lower portion of the pressing device initially contacts the sub-panel at a lower region thereof, and as the pressing device continues on its rotary path, a contact area between the outermost pressing surface and the sub-panel increases, wherein the outermost pressing surface is formed by three finger members mounted on the horizontal arm member and arranged such that the three finger members form a triangular profile with a central finger member extending perpendicularly from the horizontal arm member and two lateral finger members, on respective opposite sides of the central finger member, angled inwardly towards the central finger member.

13. A method according to claim 12, wherein the partially formed container comprises boundary zones defined by pre-formed lines of weakness in a region of the end closure, and wherein the lateral edge regions include the obliquely inwardly arranged portions such that upon said pressing no unwanted bending about the boundary zones occurs as a result of the presence of the anvil device.

14. A method according to claim 13, wherein the boundary zones are of a wave-form.

15. A method according to claim 12 further comprising forming a bend in a material of the partially formed container about a boundary zone free from a pre-formed line of weakness, wherein forming the bend comprises: receiving the partially formed container, moving a forming device relative to the partially formed container such that a first wall portion of the forming device abuts against an external surface of a first body panel of the partially formed container on one side of the boundary zone and a second wall portion extending obliquely inwardly at an angle relative to the first wall portion abuts against an external surface of a second body panel of the partially formed container on another side of the boundary zone, wherein the second wall portion contacts the partially formed container before the first wall portion and serves to urge the second body panel to the same angle relative to the first body panel as between itself and the first wall portion.

16. A forming anvil device for insertion into an end closure region of a partially formed container, the anvil device comprising:

a front edge region, a rear edge region, respective lateral edge regions extending between the front and rear edge regions, and first and second forming portions each having a corner-forming zone, wherein an apparatus comprising the forming anvil device further comprises a pressing device comprising an outermost pressing surface and being connected to a horizontal arm member running across one side of the partially formed container and rotatable about an axis, whereby rotating the arm member rotates the outermost pressing surface about the axis, wherein the outermost pressing surface is arranged at an oblique angle relative to the axis, and wherein the outermost pressing surface is formed by three finger members mounted on the horizontal arm member and arranged such that the three finger members form a triangular profile with a central finger member extending perpendicularly from the horizontal arm member and two lateral finger members, on respective opposite sides of the central finger member, angled inwardly towards the central finger member.

* * * * *